US005884484A

United States Patent [19]

Higuchi et al.

[11] Patent Number: 5,884,484

[45] Date of Patent: Mar. 23, 1999

[54] COMBUSTOR HAVING A DUCT WITH A REDUCED PORTION AND AN ORIFICE PLATE

[75] Inventors: Hikaru Higuchi; Eito Matsuo, both of Nagasaki-ken, Japan

[73] Assignee: Mitsubishi Heavy Industries, Ltd., Tokyo, Japan

[21] Appl. No.: 846,638

[22] Filed: Apr. 30, 1997

[51] Int. Cl.[6] ..... F02G 3/00

[52] U.S. Cl. ..... 60/752

[58] Field of Search ..... 60/732, 752, 760

[56] References Cited

U.S. PATENT DOCUMENTS 3,082,603 3/1963 Hering et al. ..... 60/752
3,175,361 3/1965 Schirmer et al. ..... 60/752
4,927,349 5/1990 Schirmer et al. ..... 60/732
5,285,628 2/1994 Korenberg ..... 60/752

*Primary Examiner*—Charles G. Freay
*Attorney, Agent, or Firm*—Alston & Bird LLP

[57] ABSTRACT

There is provided a combustor which produces high-temperature combustion gas and supplies the combustion gas to a driving apparatus, characterized in that a reducing portion is provided on a duct, an orifice plate is provided protruding from the parallel inner peripheral surface of the duct on the upstream side of the reducing portion, and the duct is disposed between a combustor inner tube and a combustor outlet pipe, thereby making the temperature of the combustion gas flowing from the combustor inner tube to the combustor outlet pipe substantially uniform.

3 Claims, 2 Drawing Sheets

COMBUSTOR HAVING A DUCT WITH A REDUCED PORTION AND AN ORIFICE PLATE

FIELD OF THE INVENTION AND RELATED ART STATEMENT

The present invention relates to a combustor which produces combustion gas and supplies high-temperature combustion gas to a driving apparatus such as a gas turbine.

A typical conventional combustor, in which fuel supplied from a fuel nozzle is burned together with air supplied from an air compressor etc. to produce high-temperature combustion gas, and the high-temperature combustion gas is supplied to a driving apparatus such as a gas turbine, is shown in FIG. 3.

As shown in the figure, the conventional combustor 30 comprises a combustor inlet casing 32 provided with an air inlet pipe 31 for introducing compressed air from an air compressor (not shown), a combustor outer tube 34 fixed to the downstream side of the combustor inlet casing 32 by means of bolts, and a combustor side wall 35 fixed, by means of bolts, to the end opposite to the side on which the combustor outer tube 34 and the combustor inlet casing 32 are connected to each other. These elements constitutes an external shell of the combustor.

In the combustor outer tube 34, a combustor inner tube 36 is arranged coaxially. The combustor inner tube 36 is supported by a support member 37 protruding from the inner peripheral surface of the combustor outer tube 34.

To the downstream end of the combustor inner tube 36 is connected a combustor outlet pipe 40. The combustor outlet pipe 40 penetrates the combustor inlet casing 32 and is supported by the combustor inlet casing 32 at the outer peripheral surface of the penetrating portion. On the other hand, a fuel nozzle 39 is installed at the center of the combustor side wall 35. The tip end of the fuel nozzle 39 protrudes to the upstream end of the combustor inner tube 36. Also, an ignition plug 38 penetrates the combustor outer tube 34 and is installed thereto. The tip end of the ignition plug 38 protrudes to the downstream side from the tip end of the fuel nozzle 39 protruding into the combustor inner tube 36. Further, a perforated plate 33 is disposed in the combustor inlet casing 32.

The downstream end of the combustor inner tube 36 is inserted into an expanded portion provided at the upstream end of the combustor outlet pipe 40 and connected thereto so that the combustor outlet pipe 40 and the combustor inner tube 36 can slide relatively in the pipe axis direction. The outer peripheral surface of the combustor inner tube 36 is supported by the support member 37. Between the combustor outlet pipe 40 and the combustor inlet casing 32 is provided a gap. The gap between the combustor outlet pipe 40 and the combustor inlet casing 32 is small, and moreover can be sealed, thereby preventing the compressed air flowing into the external shell from flowing to the outside through this gap.

In the conventional combustor 30 configured as described above, the compressed air entering the combustor inlet casing 32 through the air inlet pipe 31 passes through the perforated plate 33 and flows along the outer peripheral surfaces of the combustor outlet pipe 40 and combustor inner tube 36. On the other hand, the combustor inner tube 36 is heated by the combustion gas generated by the burning of the fuel supplied from the fuel nozzle 39 and the later-described heated compressed air. The compressed air introduced from the combustor inlet casing 32 cools the heated combustor outlet tube 40 and combustor inner tube 36 from the outer peripheral surface thereof, and also cools the combustor inlet casing 32, combustor outer tube 34, and combustor side to wall 35 from the inside thereof.

On the other hand, the compressed air itself is heated by these cooling operations, and flows into the combustor inner tube 36 through a plurality of air holes formed by penetrating the combustor inner tube 36. In the combustor inner tube 36, the heated compressed air is mixed with the fuel sprayed from the fuel nozzle 39, and burned by the ignition of the ignition plug 38 to produce combustion gas. The combustion gas flows out of the combustor outlet pipe 40 connected to the downstream side of the combustor inner tube 36, being supplied to a driving apparatus such as a gas turbine, not shown.

However, the temperature distribution of the combustion gas, which is produced in the combustor inner tube 36 and flows out of the combustor outlet pipe 40, in the combustor outlet pipe 40 is as shown in FIG. 4. The temperature of combustion gas flowing in the center of the combustor outlet pipe 40 is high, and the temperature thereof decreases at a position closer to the pipe wall. The difference in temperature between at the center and at a position close to the pipe wall is as large as several hundred degrees. The tendency to produce a sudden difference in temperature distribution increases as the combustion gas temperature increases.

Therefore, even if a device for measuring the combustion gas temperature is provided, the combustion gas temperature cannot be measured accurately. For this reason, combustion gas having a temperature higher than the design value is produced in the combustor 30, and supplied to a gas turbine etc. disposed on the downstream side of the combustor 30 without being uniformized, so that there is a possibility that a trouble such as thermal deformation and burning occurs on a turbine casing, not shown, etc.

OBJECT AND SUMMARY OF THE INVENTION

The present invention was made to solve the above problem with the conventional combustor, and accordingly an object thereof is to provide a combustor in which the temperature distribution of combustion gas produced in a combustor inner tube and flowing out from a combustor outlet pipe is made uniform by decreasing the difference in temperature between the combustion gas flowing at the portion near the pipe wall of the combustor outlet pipe and the combustion gas flowing at the central portion thereof, by which the temperature of combustion gas can be measured accurately.

To achieve the above object, the combustor in accordance with the present invention is configured as follows: A duct is interposed between the combustor inner tube in which combustion gas is produced and the combustor outlet pipe through which combustion gas flows out from the combustor. The duct is provided with a reducing portion in which the flow path cross-sectional area is decreased continuously and an orifice plate protruding from the parallel inner peripheral surface of duct having a substantially constant flow path cross-sectional area on the upstream side of the reduced portion. Thereby, the temperature distribution of the combustion gas flowing from the combustor inner tube to the combustor outlet pipe in the flow cross section is made uniform.

The number of orifice plates at the parallel portion of duct may be one, or a plurality of orifice plates may be provided in appropriately spaced relation in the flow direction at the parallel portion.

The space between the orifice plate and the reducing portion provided on the downstream side of the orifice plate and the space between the orifice plates provided in plural numbers are determined from the hydrodynamic viewpoint.

In the combustor in accordance with the present invention, by the above-described means, combustion gas is produced in the combustor inner tube by the burning of the introduced compressed air and fuel and flows to the combustor outlet pipe. The relatively low-temperature combustion gas flowing at the portion near the tube wall of duct is mixed with the relatively high-temperature combustion gas flowing at the central portion of duct by one annular orifice plate protruding from the inner peripheral surface of the parallel portion of duct or a plurality of orifice plates provided at predetermined intervals in the flow direction, thereby forming a turbulent flow having a substantially uniform temperature distribution.

This turbulent flow having a uniform temperature distribution is further mixed by the reducing portion provided on the duct on the downstream side close to the combustor outlet pipe from the position of orifice plate, and straightened. Thereby, the temperature distribution of combustion gas flowing in the combustor outlet pipe in the flow cross section is made substantially uniform, and the flow of combustion gas is straightened.

Thereby, even if combustion gas having a locally high temperature is produced in the combustor, a trouble such as thermal deformation and burning occurring on a turbine casing etc. installed on the downstream side of the combustor can be prevented.

Also, by installing a temperature measuring device on the combustor outlet pipe, the temperature of combustion gas can be measured accurately. If the combustor is operated based on the measured temperature, the combustion gas temperature can be controlled, so that not only the aforesaid trouble can be prevented, but also an efficient operation of the combustor can be performed.

DETAILED DESCRIPTION OF PREFERRED EMBODIMENTS

Figure 1:
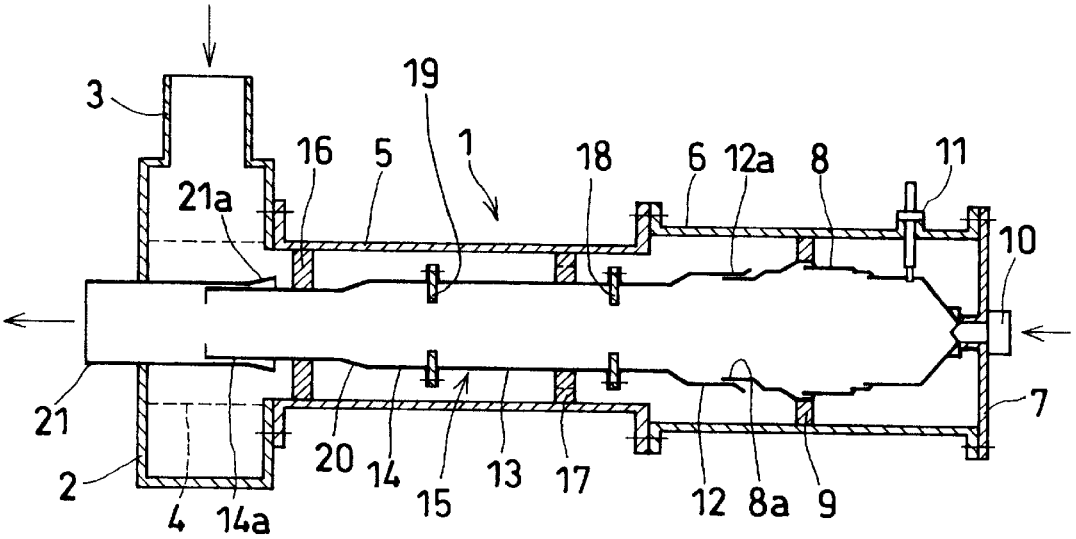
FIG. 1 is a longitudinal sectional view showing an embodiment of a combustor in accordance with the present invention.

An embodiment of a combustor in accordance with the present invention will be described with reference to the accompanying drawings. FIG. 1 is a longitudinal sectional view showing an embodiment of a combustor in accordance with the present invention.

As shown in FIG. 1, a combustor 1 of this embodiment comprises a combustor inlet casing 2 provided with an air inlet pipe 3 for introducing compressed air from an air compressor (not shown) and a perforated plate 4 installed therein, a temperature uniformizing device outer tube 5 connected to the downstream side wall of the combustor inlet casing 2 by means of bolts, a combustor outer tube 6 connected, by means of bolts, to the end of the temperature uniformizing device outer tube 5 on the side opposite to the portion connected to the combustor inlet casing 2, and a combustor side wall 7 connected, likewise by means of bolts, to the end of the combustor outer tube 6 on the side opposite to the portion connected to the temperature uniformizing device outer tube 5. These elements constitutes an external shell of the combustor.

In the combustor outer tube 6, a combustor inner tube 8 is arranged coaxially. The combustor inner tube 8 is supported by an annular support member 9 protruding from the inner peripheral surface of the combustor outer tube 6 so as to be slidable in the axial direction.

At the center of the combustor side wall 7, a fuel nozzle 10 penetrates the side wall 7 and is installed thereto. The tip end of the fuel nozzle 10 protrudes to the upstream end of the combustor inner tube 8. Also, an ignition plug 11 penetrates the combustor outer tube 6 and is installed thereto. The tip end of the ignition plug 11 protrudes in the combustor inner tube 8 on the downstream side from the tip end of the fuel nozzle 10.

In the temperature uniformizing device outer tube 5, a duct 15, which is integrated by connecting a duct 12, duct 13, and duct 14 by means of bolts, for example, is arranged coaxially. In an expanded portion 12*a* provided at the upstream end of the duct 12, a downstream end 8*a* of the combustor inner tube 8 is inserted. Thereby, the duct 15 and the combustor inner tube 8 are connected to each other so as to be moved relatively in the axial direction. Further, the connecting portion between the duct 12 and the combustor inner tube 8 is sealed.

The outer peripheral surface of the duct 14 is fixed to the temperature uniformizing device outer tube 5 by a fixing member 16, and the outer peripheral surface of the duct 13 is supported by a support member 17 fixed to the inner peripheral surface of the temperature uniformizing device outer tube 5 so as to be slidable in the axial direction.

Between flanges provided for the connection between the duct 12 and duct 13 and between the duct 13 and duct 14 by means of bolts, annular orifice plates 18 and 19 are interposed, respectively. The respective orifice plates 18 and 19 are tightened and fixed by means of bolts for connecting the flanges. Also, at the central portion of the duct 14, a reducing portion 20, at which the cross-sectional area of duct is reduced toward the downstream side of flow of combustion gas flowing in the duct 14, is provided.

Proper spaces are provided between the orifice plate 18, orifice plate 19, and reducing portion 20 provided in the duct 15. By these proper spaces, the combustion gas flow in the duct 15 is made turbulent hydrodynamically, mixing is effected, the nonuniformity of temperature is corrected, and the turbulent combustion gas is straightened.

The rear end 14*a* of the duct 14 is inserted in an expanded portion 21*a* provided at the tip end of a combustor outlet pipe 21 with a gap provided between them, by which the duct 14 is connected to the combustor outlet pipe 21. The combustor outlet pipe 21 penetrates the combustor inlet casing 2, and the outer peripheral surface thereof is supported at this penetrating portion so that the combustor outlet pipe 21 is slidable in the axial direction. Therefore, the combustor outlet pipe 21 can slide in the pipe axis direction independently of the duct 14 fixed to the temperature uniformizing device 5 by the fixing member 16.

The gap at the fitting portion between the rear end of the duct 14 and the combustor outlet pipe 21 and the gap at the penetrating portion between the combustor outlet pipe 21 and the combustor inlet casing 2 are small, and moreover can be sealed, thereby preventing the compressed air flowing into the external shell from flowing to the outside through these gaps.

In the combustor 1 of this embodiment configured as described above, the compressed air entering the combustor inlet casing 2 through the air inlet pipe 3 passes through the perforated plate 4 and flows from the left side to the right side in the figure along the outer peripheral surfaces of the combustor outlet pipe 21, duct 15, and combustor inner tube 8. On the other hand, the combustor inner tube 8 is heated by the combustion gas generated by the burning of the fuel supplied from the fuel nozzle 10 and the compressed air. The compressed air introduced from the combustor inlet casing 2 cools the heated combustor outlet pipe 21, duct 15, and combustor inner tube 8 from the outer peripheral surface thereof, and also cools the combustor inlet casing 2, temperature uniformizing device outer tube 5, combustor outer tube 6, and combustor side wall 7 from the inside thereof.

The compressed air heated by these cooling operations flows into the combustor inner tube 8 through a plurality of air holes (not shown) formed by penetrating the combustor inner tube 8, being mixed with the fuel sprayed from the fuel nozzle 10, and is burned by the ignition of the ignition plug 11 as described above to produce combustion gas.

On the other hand, high-temperature combustion gas produced in the combustor inner tube 8 flows to the duct 15 connected to the downstream end of the combustor inner tube 8, and the flow thereof along the tube wall is directed to the tube center by the orifice plate 18 interposed between the flanges of the duct 12 and duct 13 and by the orifice plate 19 interposed between the flanges of the duct 13 and duct 14. After passing through the orifice plates 18 and 19, the central flow is directed to the tube wall, and the combustion gas flow is made turbulent, whereby the relatively low-temperature combustion gas flowing in the vicinity of the tube wall is mixed with the relatively high-temperature combustion gas flowing at the central portion.

Thereupon, although the combustion gas usually has a temperature difference produced according to the flow position in the duct 15, this embodiment provides a flow having a substantially uniform temperature distribution on the downstream side of the orifice plate 19.

Figure 2:
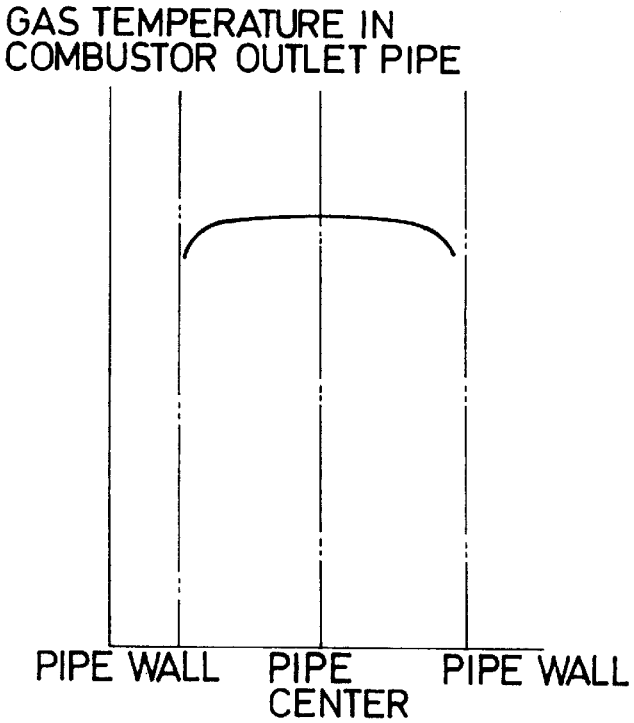
FIG. 2 is a graph showing a combustion gas temperature distribution in a combustor outlet pipe in the embodiment shown in FIG. 1.
Figure 3:
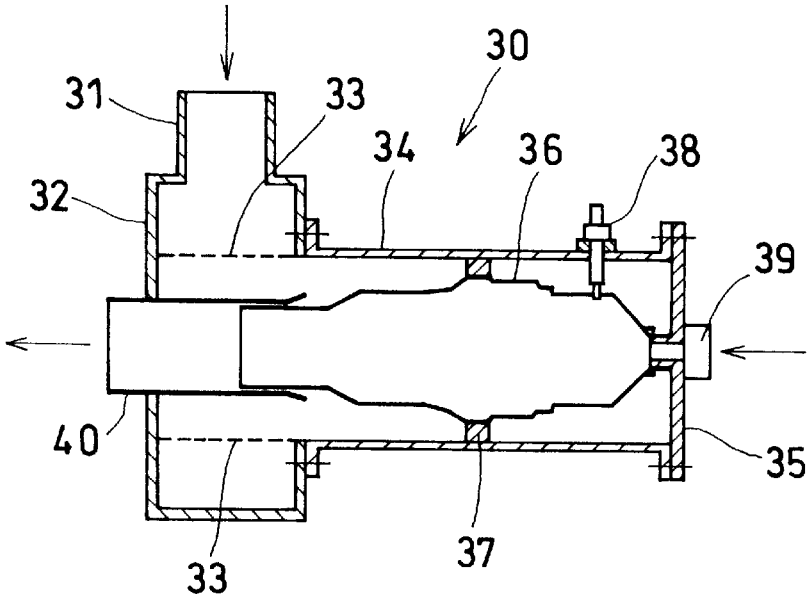
FIG. 3 is a longitudinal sectional view of a conventional combustor.
Figure 4:
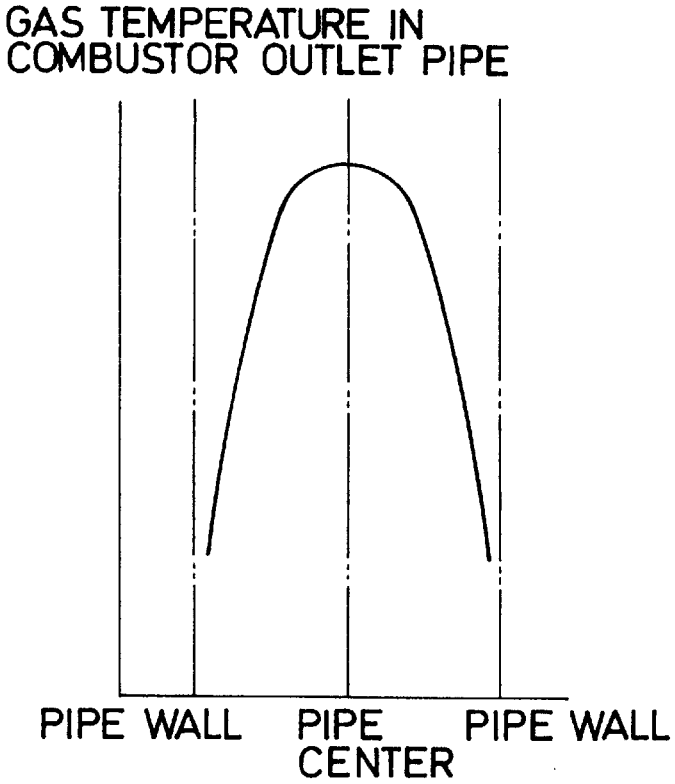
FIG.4 (RELATED ART)
FIG. 4 is a graph showing a combustion gas temperature distribution in a conventional combustor outlet pipe.

FIG. 2 shows a temperature distribution obtained by an experiment performed in the case where the space between the orifice plates 18 and 19 having an opening area ratio of 0.5 is 2D (D is the diameter of duct 13) and the space between the orifice plate 19 and reducing portion 20 is 1D. This figure indicates that the flow has a flat temperature distribution scarcely having a temperature difference between the tube wall and tube center.

The combustion gas, the flow of which is made turbulent by the orifice plates 18 and 19 and therefore the temperature of which is made uniform, is further uniformized in temperature by the reducing portion 20 provided at the central portion of the duct 14, and is straightened. The straightened combustion gas flows to the combustor outlet pipe 21 connected to the downstream side of the duct 14, being supplied to a driving apparatus such as a gas turbine, not shown.

The straightening of flow can prevent the occurrence of vibration and noise caused by the turbulence of combustion gas in the combustor outlet pipe 21 and a pipe connecting the combustor outlet pipe 21 to the driving apparatus.

Thereupon, according to this embodiment, thermal deformation and burning, which have so far been caused on the equipment including piping installed on the downstream side of the combustor 1 by the combustion gas with a nonuniform temperature distribution in which the temperature is locally high, can be prevented. Also, a temperature measuring device is installed to the combustor outlet pipe to measure the temperature of combustion gas accurately, by which the temperature control of combustor can be carried out with high accuracy in accordance with the load, resulting in an efficient operation of the combustor 1.

Although a combustor provided with two orifice plates 18 and 19 in the duct 15 has been described in the above-mentioned embodiment, the present invention is not limited to this embodiment. The number of orifice plates and the protruding length thereof into the duct can be selected appropriately to achieve the object of the present invention.

Also, the orifice plate, which is installed in the high-temperature combustion gas, can be manufactured from a ceramic material etc., and two-piece orifice plate may be used in combination.

As described above, according to the combustor of the present invention, by a configuration showing in the claims, the high-temperature gas at the central portion is mixed with the low-temperature gas at the portion near the tube wall by the orifice plates installed in the duct although the combustion gas usually has a temperature distribution such that the gas temperature is high in the center of the combustor inner tube outlet portion and low at the portion near the tube wall, and the combustion gas is straightened by the reducing portion provided on the duct, whereby a straightened combustion gas with a substantially uniform temperature can be obtained. Thereby, the temperature of the combustor outlet pipe portion can be measured accurately.

Therefore, measures can be taken at the planning stage of gas turbine etc. to prevent a trouble such as thermal deformation and burning on a turbine casing on the downstream side of the combustor. Also, the temperature control of combustion gas can be carried out with high accuracy, so that an efficient operation of combustor can be performed, resulting in improved plant efficiency.

We claim:

1. A combustor which produces high-temperature combustion gas and supplies said combustion gas to a driving apparatus, characterized in that a reducing portion is provided on a duct, an orifice plate is provided protruding from an inner peripheral surface of said duct on the upstream side of said reducing portion, said inner peripheral surface having opposed sides which are parallel, and said duct is disposed between a combustor inner tube and a combustor outlet pipe, thereby making the temperature of said combustion gas flowing from said combustor inner tube to said combustor outlet pipe substantially uniform.

2. A combustor according to claim 1, wherein a plurality of said orifice plates are provided on the inner peripheral surface of said duct.

3. A combustor according to claim 1, wherein said duct is fitted slidably to said combustor inner tube and said combustor outlet pipe.

* * * * *